United States Patent [19]

Bryan, Jr.

[11] 4,172,529

[45] Oct. 30, 1979

[54] CRANE

[75] Inventor: John F. Bryan, Jr., Dallas, Tex.

[73] Assignee: Pyramid Manufacturing Company—a division of Precorp, Houston, Tex.

[21] Appl. No.: 929,700

[22] Filed: Jul. 31, 1978

Related U.S. Application Data

[62] Division of Ser. No. 721,775, Sep. 9, 1976, abandoned.

[51] Int. Cl.[2] ..... B66C 23/72

[52] U.S. Cl. ..... 212/48; 212/59 R; 414/719

[58] Field of Search ..... 212/48, 49, 58 R, 59 R; 214/142

[56] References Cited

U.S. PATENT DOCUMENTS

| | | | |
|---|---|---|---|
| 1,245,186 | 11/1917 | Brothers | 212/49 |
| 2,368,268 | 1/1945 | Spiegel | 212/49 |

FOREIGN PATENT DOCUMENTS

| | | | |
|---|---|---|---|
| 2133111 | 1/1972 | Fed. Rep. of Germany | 212/58 R |
| 1051231 | 4/1902 | France | 212/48 |
| 1413966 | 9/1965 | France. | |
| 1498123 | 11/1966 | France | 212/49 |
| 627307 | 8/1949 | United Kingdom | 254/175.7 |
| 1432464 | 4/1976 | United Kingdom | 212/58 R |
| 1440596 | 6/1976 | United Kingdom | 212/58 R |
| 454144 | 2/1975 | U.S.S.R. | 214/142 |

*Primary Examiner*—Lawrence J. Oresky

*Attorney, Agent, or Firm*—Richards, Harris & Medlock

[57] ABSTRACT

The specification discloses a crane including a base having a boom pivotally supported at one end from the base. The opposite end of the boom is adapted for receiving the load to be carried by the crane. A mast and upper tension member system are affixed to the top surface of the boom, supporting the load receiving end of the boom so that the boom structure is relieved of bending moments. Hydraulic cylinders are connected between the base and the boom for elevating and lowering the boom. In one embodiment the upper tension member system includes a spring and dampener which serves to cushion dynamic overloads during operation of the crane. In another embodiment a counterweight is hingedly attached to the end of the boom supported from the base. The weight of the counterweight is borne by a cable which joins into the upper tension member system. In yet another embodiment the tension member system supporting the load receiving end of the boom includes diagonally arrayed cables which serve to counteract loads imposed on the boom by operation in out of level conditions such as attendant to rough terrain or marine applications. When the counterweight is aligned with the boom, it may be selectively moved from an extended to a retracted position along a path substantially parallel to the longitudinal axis of the boom. The crane is adapted with structure for maintaining the hingeable counterweight horizontal as the boom is rotated on the base.

16 Claims, 19 Drawing Figures

CRANE

This is a division of application Ser. No. 721,775, filed Sept. 9, 1976, now abandoned.

FIELD OF THE INVENTION

This invention relates to hoisting apparatus and more particularly to cranes of the type used in heavy construction operations.

THE PRIOR ART

Crane structures are used extensively throughout the construction industry for hoisting and moving materials and equipment used in the building process. Generally, the cranes are composed of a base structure rotatably mounted on either a stationary foundation or a mobile power unit. A boom is pivotally attached to the base structure, and a hoisting cable, generally controlled from an operating station near or on the base structure, depends from the end of the boom for attaching loads thereto. A gantry structure is fixedly attached to the base, behind the boom pivot, and a cable system runs from the top of the gantry to the point of the boom. The boom is elevated and lowered by means of this cable system.

Some prior art crane structures have employed counterweights which are rigidly attached to the boom. This arrangement provides none of the advantages of a hinged, retractable counterweight. When the boom is pivoted upwardly the counterweight moves correspondingly downwardly thus the moment arm of the counterweight must be relatively short if interference with the ground or supporting structure is to be avoided. This limits the efficiency of such a counterweight. Still other crane systems include a fixed counterweight extending from the base structure. The counterweight in these units is neither retractable nor hingeable thus providing no means for overcoming clearance problems. Further, these systems are far less effective for counter balancing the load on the boom than the systems having the counterweight extending from the boom.

SUMMARY OF THE INVENTION

The present invention discloses an improved load lifting crane structure which overcomes many of the deficiencies of prior art apparatus by utilizing a mast and upper tension member system affixed to the top surface of the boom. This system permits the use of hydraulic cylinder means for elevating the boom while subjecting the boom only to compressive loads and not to bending moments. This system also permits the adaptation of a counterweight to a crane in a novel manner whereby the counterweight is supported by a tension member which joins into the upper tension member system to achieve a uniquely effective load path.

In accordance with one embodiment of the invention, the crane structure comprises a base having a boom pivotally supported at one end from the base. The opposite end of the boom is adapted for receiving the load to be lifted by the unit. Hydraulic cylinder(s) are connected to the base and to an intermediate location on the boom such that when the cylinder(s) are retracted the boom is substantially horizontal and when the cylinders are extended the boom pivots to a position approaching the vertical. A mast is attached to the boom at a location on the upper surface of the boom and provides for a rearwardly disposed tension member or back-stay running from the top of the mast to the rear portion of the boom, and a forwardly disposed tension member or pendant line running from the top of the mast to the point of the boom.

In accordance with another embodiment of the invention the back-stay member can be made as an extendable spring and dampener that will serve to cushion dynamic overloads such as are incited by wave action in marine applications.

In accordance with yet another embodiment of the invention the mast is given a lateral dimension approaching or exceeding the width of the boom cross section and the forwardly disposed upper tension members include at least two diagonal components running from one side of the upper end of the mast to the opposite side of the boom. The diagonal components are preferably clamped together at the point where they cross. This arrangement serves to support the end of the boom during operation in out of level conditions in such a manner that the boom is not subjected to twisting and side bending moments.

In accordance with yet another embodiment of the invention a counterweight is hingedly attached to the end of the boom supported from the base. When the counterweight is aligned with the boom, it may be selectively moved from an extended to a retracted position along a path substantially parallel to the longitudinal axis of the boom. In this embodiment of the invention, the fact that the counterweight is not fixedly attached to the boom but is hinged therefrom permits the counterweight to be angularly rotated relative to the boom during hoisting operations. In this way, the counterweight may be extended to work at a significantly greater radius than would be possible with a fixed boom-counterweight structure. Because the counterweight may be retracted relative to the boom, clearance problems caused by structures adjacent the work area of the crane are likewise overcome.

In this embodiment, the crane of the present invention is adapted with structure for maintaining the hingeable counterweight structure substantially horizontal as the boom is pivoted on the base. In this arrangement, the counterweight is hinged relative to the boom and is maintained horizontal regardless of the vertical angle of the boom while hoisting or performing similar operations. The hingeable counterweight structure, when maintained horizontal throughout the angular elevation range of the boom, eliminates ground clearance problems that would otherwise obtain in that the counterweight stays in substantially the same position relative to the ground and other surrounding structure as the boom elevates.

In accordance with another embodiment of the present invention, the counterweight comprises a longitudinal arm hingedly attached from the boom in the vertical plane of the boom. Attached to the end of the longitudinal arm remote from the boom is a weight unit wherein the weight of the counterweight unit is concentrated. This counterweight structure is chosen in order to provide the bulk of the weight of the counterweight with a maximum moment arm through which to act thereby increasing the effectiveness of the counterweight. In accordance with this embodiment of the invention, structure is also provided for hinging the arm relative to the boom structure to maintain the longitudinal axis of the arm substantially horizontal as the boom is rotated in a vertical plane.

In this embodiment of the invention, not only are the problems heretofore experienced with respect to ground clearance alleviated, but additionally the compensating moment provided by the counterweight is maintained at a maximum by retaining the maximum moment arm through which the concentrated weight unit acts as the boom elevates. This configuration is to be contrasted to prior art units where the counterweight rotates with the boom thereby reducing the effective moment arm through which the counterweight acts.

In this embodiment of the invention, the structure for maintaining the counterweight horizontal includes a mast extending substantially perpendicularly from the boom, a first pulley system attached to the top of the mast and a second pulley system attached to the base. A cable system extends from the counterweight and is entrained about the first pulley system and the second pulley system and attached to the boom whereby pivoting of the boom varies the length of the section of the cable system between the counterweight and the first pulley system to maintain the counterweight horizontal as the boom is pivoted.

In accordance with another embodiment of the invention, the structure for maintaining the counterweight level during rotation of the boom further includes a third pulley system attached to the boom. In this embodiment of the invention, the cable system extends from the counterweight and is entrained about the first pulley system and multiply wrapped about the second and third pulley systems whereby pivoting of the boom varies the length of the section of the cable system between the counterweight and the first pulley system to compensate for pivoting of the mast with the boom to maintain the counterweight horizontal as the boom rotates.

In accordance with still another embodiment of the invention, a triangular structure has one corner rotatably attached to the underside of the boom with at least one pulley attached to a second corner thereof and a bearing surface on a third corner for bearing against the underside of the boom as the boom is pivoted upwardly. The pulley attached to the triangular structure is adapted to receive a plurality of wraps from the second pulley system. This arrangement for maintaining the counterweight horizontal during rotation of the boom compensates for decreasing drawup of the cable system during high angles of rotation by the boom.

In accordance with still another embodiment of the invention, the structure for maintaining the counterweight horizontal during rotation of the boom comprises a measuring device for measuring the position of the counterweight relative to horizontal. A servo system is connected to the counterweight and is operative in response to the measuring device to hinge the counterweight relative to the boom in order to reposition the counterweight to horizontal as the boom pivots.

In accordance with still another embodiment of the invention, a winch is provided with a cable extending from the winch to the counterweight. The winch is operative in response to a device for measuring the angular position of the counterweight relative to horizontal such that the winch is energized to draw up and let out the cable in order to maintain the counterweight level as the boom rotates.

In accordance with still another embodiment of the present invention, a cable system is provided extending through the boom to its load bearing end. The cable is adapted for supporting the load to be carried by the boom. A hoist mechanism is supported by the base structure and is adapted for controlling the length of the cable system to raise and lower the loads attached thereto. The hoist mechanism comprises two sets of opposed pulleys about which the cable system is alternately wrapped. Each set of pulleys has a common rotational axis, and the axis of one set is parallel to the axis of the second set. The multiple wraps of the cable system about the pulleys generate sufficient traction on the cable system to restrain the cable under the loads attached thereto.

DESCRIPTION OF THE DRAWINGS

For a more complete understanding of the present invention, and for further details and advantages thereof, reference is now made to the following description taken in conjunction with the accompanying drawings in which.

DESCRIPTION OF THE PREFERRED EMBODIMENTS

Figure 1:
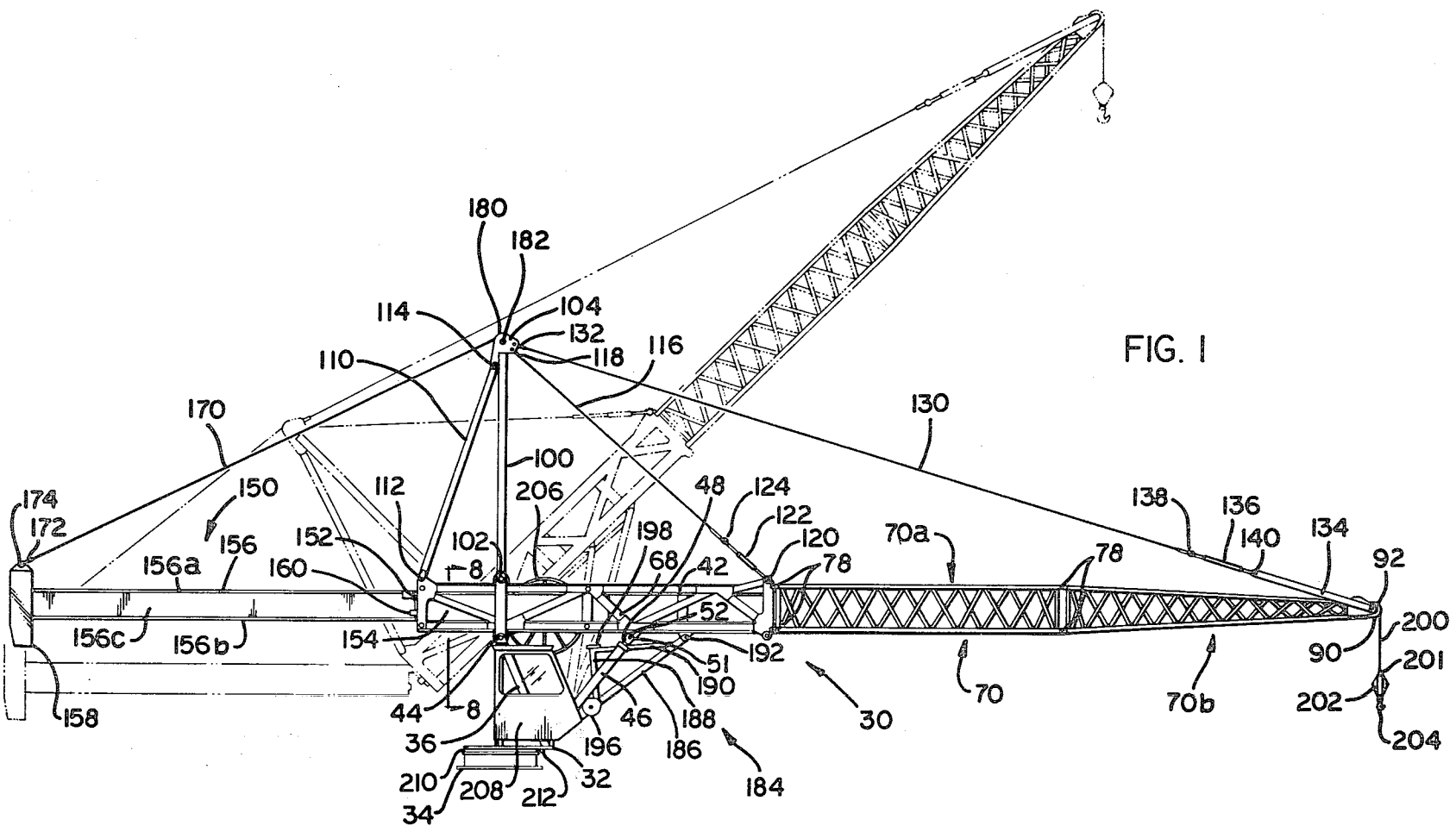
FIG. 1 is a side elevational view of an embodiment of the crane embodying the present invention.

FIG. 1 illustrates a side view of a crane 30 embodying the present invention. Crane 30 includes a base structure 32 rotatably secured to a foundation structure 34. Extending from base 32 is superstructure 36, to which a boom 42 is attached. Superstructure 36 is rigidly attached to base 32 and boom 42 pivots at the upper end by axis shaft 44. Support member 40, in a preferred embodiment of the invention, is a hydraulic ram including a ram cylinder 46 and a ram piston 48 which is joined to a clevis 50. One end of hydraulic ram cylinder 46 is rotatably attached to base 32 while clevis 50 is rotatably pinned to a lug 51 extending from the underside of boom 42 by pin 52.

Joined at one end of boom 42 is a boom extension 70 consisting of elements 70*a* and 70*b*. The boom extension 70*a* is removably joined to main boom 42 by suitable fasteners 78 and boom extension 70*b* is joined to boom extension 70*a* by the same fasteners.

The end of boom extension 70*b* remote from boom extension 70*a* is adapted with a pulley system 90. Pulley system 90 is rotatably secured to boom extension 70*b* about rotational axis shaft 92.

Extending upwardly from main boom 42 is mast 100 which is rotatably pinned to boom structure 42 along the top surface thereof by axis shaft 102. The end of mast 100 remote from boom 42 is adapted with a juncture plate 104. Removably secured between juncture plate 104 and the rearward end of boom 42 is mast support member 110. Mast support member 110 is joined between boom 42 and juncture plate 104 by suitable pins 112 and 114, respectively. A cable assembly 116 is fixedly attached between juncture plate 104 and the most forward end of boom 42 by pins 118 and 120, respectively. Intermediate of the points of connection between juncture plate 104 and boom structure 60 is a turn buckle 122 for appropriately adjusting the tension on cable 116.

Similarly, a cable assembly 130 extends from juncture plate 104 at the uppermost end of mast 100 and the most forward end of boom extension 70*b* in order to transmit loading from the boom through the mast and into the base structure. Cable assembly 130 is joined to juncture plate 104 and boom extension 70*b* by pin 132 and connecting strap 134, respectively. In a preferred embodiment of the invention, connecting strap 134 is joined to boom extension 70*b* at axis shaft 92. A tensioning mechanism 136 is connected by suitable fasteners 138 and 140 intermediate of cable 130 and connecting strap 134 to permit selective tensioning of cable 130.

A counterweight assembly 150 is hingedly attached at pin shaft 152 to an I beam section 154 which is slidable within the boom 42. Counterweight assembly 150 is composed of an I beam section 156 rigidly attached to a weighted end unit 158. I beam section 156 is adapted with guide ears 160 for aligning the counterweight I beam section 156 with I beam section 154.

I beam section 156 includes an upper cap 156*a*, a lower cap 156*b* and a web 156*c*. Similarly, I beam section 154 includes an upper cap 154*a* (not shown), a lower cap 154*b* (not shown) and a web 154*c*. A cable system 170 is joined to weight unit 158 by coupling member 172 and pin 174. Cable system 170 extends around a pulley system 180 (not shown) positioned adjacent to juncture plate 104 at the uppermost end of mast 100. Pulley system 180 has as its rotational axis shaft 182.

Cable system 170 extends around pulley system 180 and is connected to boom 42 through a triangular take-up structure 184 in a manner to be hereinafter described in detail. Triangular take-up structure 184 consists of a rigid structure including sides 186, 188 and 190. One end of side 186 is rotatably pinned by suitable pin 192 to boom 42. The opposite end of side 186 is adapted with a pulley system 196, to be hereinafter described in greater detail. A bearing pad 198 is fixedly attached at the juncture of sides 188 and 190 and is adapted for bearing against the lower side of boom 42 during operation of the unit as will hereinafter be described in greater detail.

Also illustrated in FIG. 1 and to be described hereinafter in further detail, is hoist cable 200 extending from the load bearing end of boom extension 70*b* and about pulley system 90. Attached to the end of hoist cable 200 by pin 201 is hoist block 202 adapted with an engaging hook 204.

Referring again to FIG. 1, a take-up reel 206 is attached for rotation from the boom 42. Fixedly attached to base 32 is a cab structure 208 from which the crane unit is operated.

Crane 30 is supported for rotation about a vertical axis from base structure 32 on foundation structure 34. In a preferred embodiment of the invention, foundation structure 34 is adapted with teeth 210 about the circumference thereof. Extending from base structure 32 is a rotatable pinion wheel 212 which mates with teeth 210 on foundation structure 34. By rotating pinion wheel 212, base structure 32 and thus crane 30, may be selectively rotated about a vertical axis, relative to foundation structure 34.

Figure 2:
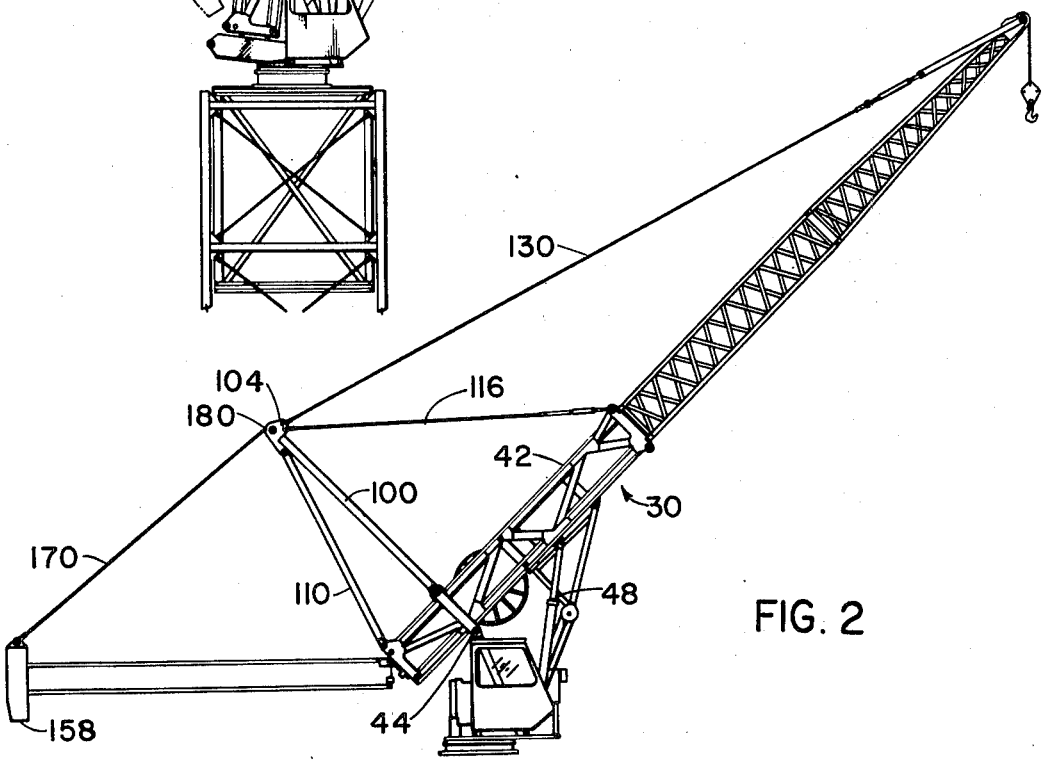
FIG. 2 is a side elevational view of the embodiment illustrated in FIG. 1 showing the boom rotated upwardly.

Referring to FIG. 2, crane 30 is shown with boom 42 pivoted upwardly about axis shaft 44. As is illustrated in FIG. 2, upward rotation of boom 42 is accomplished by extending ram piston 48 thereby causing rotation of the boom about axis shaft 44. As mast support strut 110 and support cables 116 and 130, each extending from juncture plate 104 to points along boom 42 are each fixedly attached to the boom, the relationship of mast 100 to boom 42 remains unchanged as boom 42 is rotated upwardly. Due to the leveling mechanism, to be hereinafter described in greater detail, the portion of counterweight cable system 170 between the weight unit 158 and the pulley system 180 is automatically shortened as boom 42 is raised. The arrangement for automatically taking up the counterweight cable system 170 is so designed as to maintain the longitudinal axis of counterweight assembly 150 horizontal throughout all rotational positions of the boom.

Figure 3:
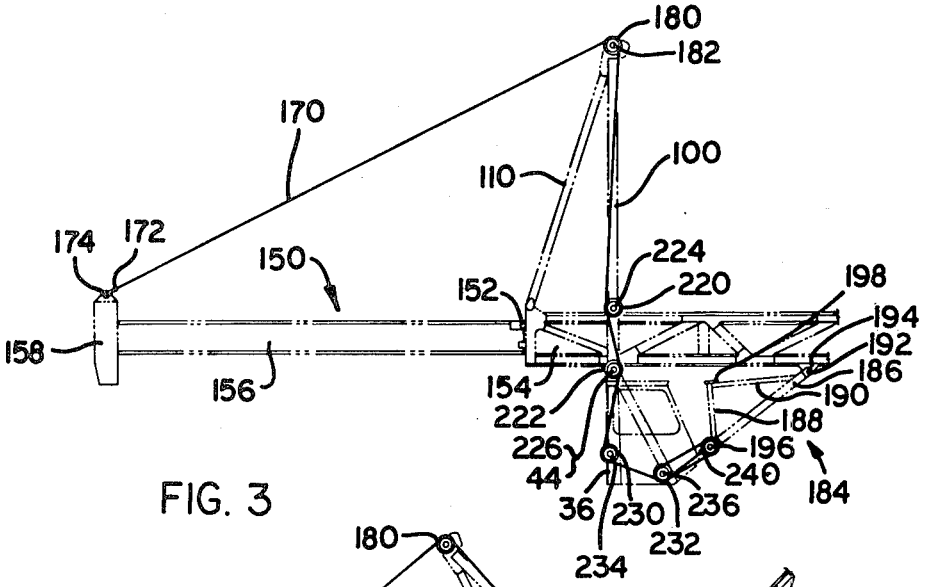
FIG. 3 illustrates one embodiment of the system for maintaining the counterweight in a horizontal configuration during rotation of the boom.
Figure 4:
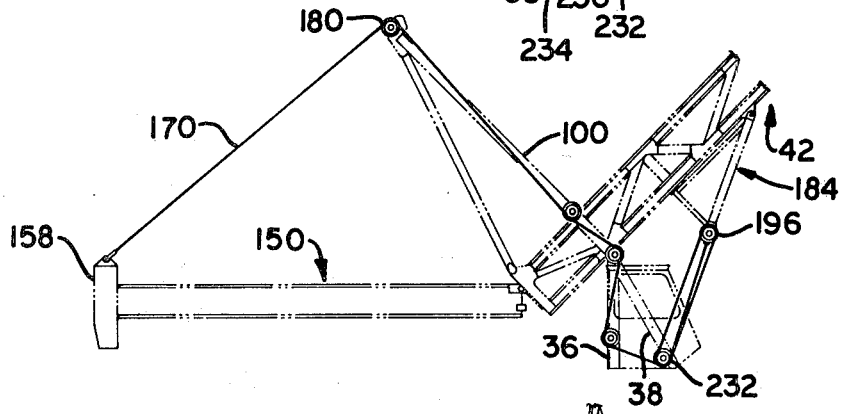
FIG. 4 shows the boom in an intermediate rotational stage with the counterweight maintained in a horizontal position by the leveling system.
Figure 5:
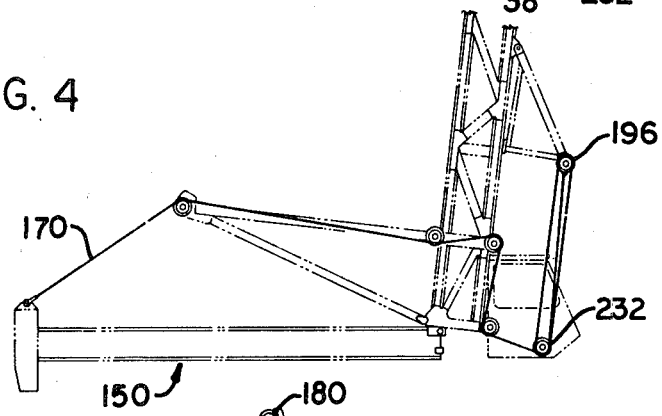
FIG. 5 shows the boom in its maximum up position with the counterweight maintained in a horizontal position by the leveling system.

One embodiment of cable system 170 is illustrated in FIGS. 3, 4 and 5. Referring to FIG. 3, the superstructure 36 is shown supporting boom 42 at axis shaft 44. Mast 100 and mast support strut 110 are shown extending from boom structure 42 as hereinbefore described.

Counterweight assembly 150 is shown hingedly attached at pin 152 to I beam 154 slidably engaged within boom structure 60. Weight unit 158 attached to the end of counterweight I beam 156 is shown connected to leveling cable system 170 by coupling member 172 and pin 174.

Rotatably attached at axis shaft 182 is pulley system 180. Similar pulley systems 220 and 222 are rotatably positioned about axes 224 and 226, respectively, on boom 42, and pulley systems 230 and 232 are rotatably attached to superstructure 36 by axes pins 234 and 236, respectively. Triangular take-up structure 184, consisting of side members 186, 188 and 190, is joined at one end of side 186 by pin 192 to ear 194 extending from the lower portion of boom structure 60. The opposite end of side 186 is adapted with pulley system 196. The corner at which sides 188 and 190 of triangular take-up structure 184 are connected is adapted with bearing pad 198 as hereinabove described. The pulley systems 196 and 232 are adapted with multiple parallel pulleys having a common axis of rotation.

Cable system 170 is attached at one end to weight unit 158 of counterweight assembly 150 by coupling member 172 and pin 174. Cable system 170 extends from weight unit 158 and is entrained alternately around pulley systems 180, 220, 222, 230 and 196. Cable system 170 is multiply wrapped about pulley systems 232 and 196 and is thereafter fixedly attached adjacent pulley system 196 by coupling member 240. Referring to FIG. 3, it may be seen that the length of cable system 170 is such that the longitudinal axis of counterweight assembly 150 is in line with longitudinal axis of boom 42 when boom 42 is in the horizontal position.

FIG. 4 illustrates the boom in a rotated position and shows the resultant effect on cable system 170 and counterweight assembly 150. Referring to FIG. 4, it may be seen that the portion of cable system 170 between weighted end unit 158 and pulley system 180 at the upper end of mast 100 is shortened as a result of the movement of pulley system 196 with the rotation of boom 42. As boom 42 rotates upwardly in a horizontal plane, pulley system 196, attached to the boom 42 by way of triangular take-up structure 184 moves upwardly with boom 60 and away from pulley system 232 attached to base support member 38. As illustrated in FIGS. 3 and 4, cable system 170 is wrapped three times about pulley systems 196 and 232. As a result, cable system 170 is drawn three times the distance pulley system 196 is moved from pulley system 232. This takeup in cable system 170 in conjunction with the arrangement of the other pulley systems about which cable system 170 is entrained, hinges counterweight assembly 150 about axis pin 152 to maintain the counterweight horizontal throughout the rotation of the boom.

Referring to FIG. 5, the boom has been rotated to its uppermost rotational position moving pulley system 196 further from pulley system 232 and thereby effectively shortening cable system 170 to maintain the counterweight assembly 150 horizontal throughout the upper movement of the boom. In the rotational positions between that illustrated in FIG. 4 and that illustrated in FIG. 5, it may be seen that triangular take-up structure 184 has been rotated about its point of connection at pin 192 toward the lower side of the boom 42 such that bearing pad 198 contacts the lower surface of boom 42. In this way, pulley 196 is maintained a sufficient distance away from boom 42 and slightly further from pulley system 232 than in the configuration where the triangular take-up structure is absent. This arrangement results in the additional takeup of the length in cable system 170 necessary in the upper rotational stages of the boom in order to maintain the counterweight assembly 150 horizontal.

Figure 6:
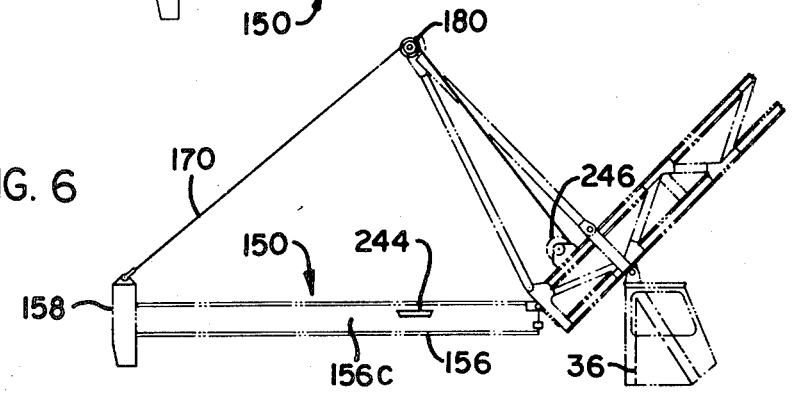
FIG. 6 illustrates an alternative embodiment for maintaining the counterweight level during rotation of the boom.

FIG. 6 illustrates an alternative embodiment of the present invention wherein the counterweight assembly is maintained in its level configuration by a leveling sensor 244 which energizes a winch unit 246 to draw in and let out cable system 170 to maintain the counterweight assembly 150 level during the movement of the boom. Referring to FIG. 6, winch unit 246 is adapted for receiving one end of cable system 170. In this embodiment, winch unit 246 is substituted for pulley systems 230 and 232 and triangular take-up structure 184. Leveling sensor 244 is attached to web **156*c* of I beam assembly 156 by suitable means. Leveling sensor 244 is of the type capable of sensing movement of counterweight assembly 150 and of generating a signal when the longitudinal axis of I beam section 156 moves out of line with the horizontal. Appropriate circuitry (not shown) is interconnected between sensor 244 and winch 246 for relaying the signal transmitted by sensor 244. Winch 246 is operative in response to the signal emitted by sensor 244 and is appropriately controlled to draw in or let out cable system 170 whenever counterweight assembly 150** rotates from the horizontal to maintain the counterweight assembly level at all times.

Thus, in this embodiment, cable system 170 extends from the weight unit 158 around pulley system 180 and is attached to winch 246. As the boom is rotated in a horizontal plane, sensor 244 generates an appropriate electrical signal which in turn energizes winch 246. In this way, cable system 170 is drawn in and let out in accordance with the signal from sensor 244 to maintain the counterweight assembly level throughout movement of the boom structure. Therefore, in the embodiment illustrated in FIG. 6, the purely mechanical method illustrated in FIGS. 3–5 for maintaining the counterweight horizontal is replaced by an electrical servo system operating a winch unit to draw in and let out the counterweight control cable necessary to maintain the counterweight horizontal.

Figures 7, 8, 9:
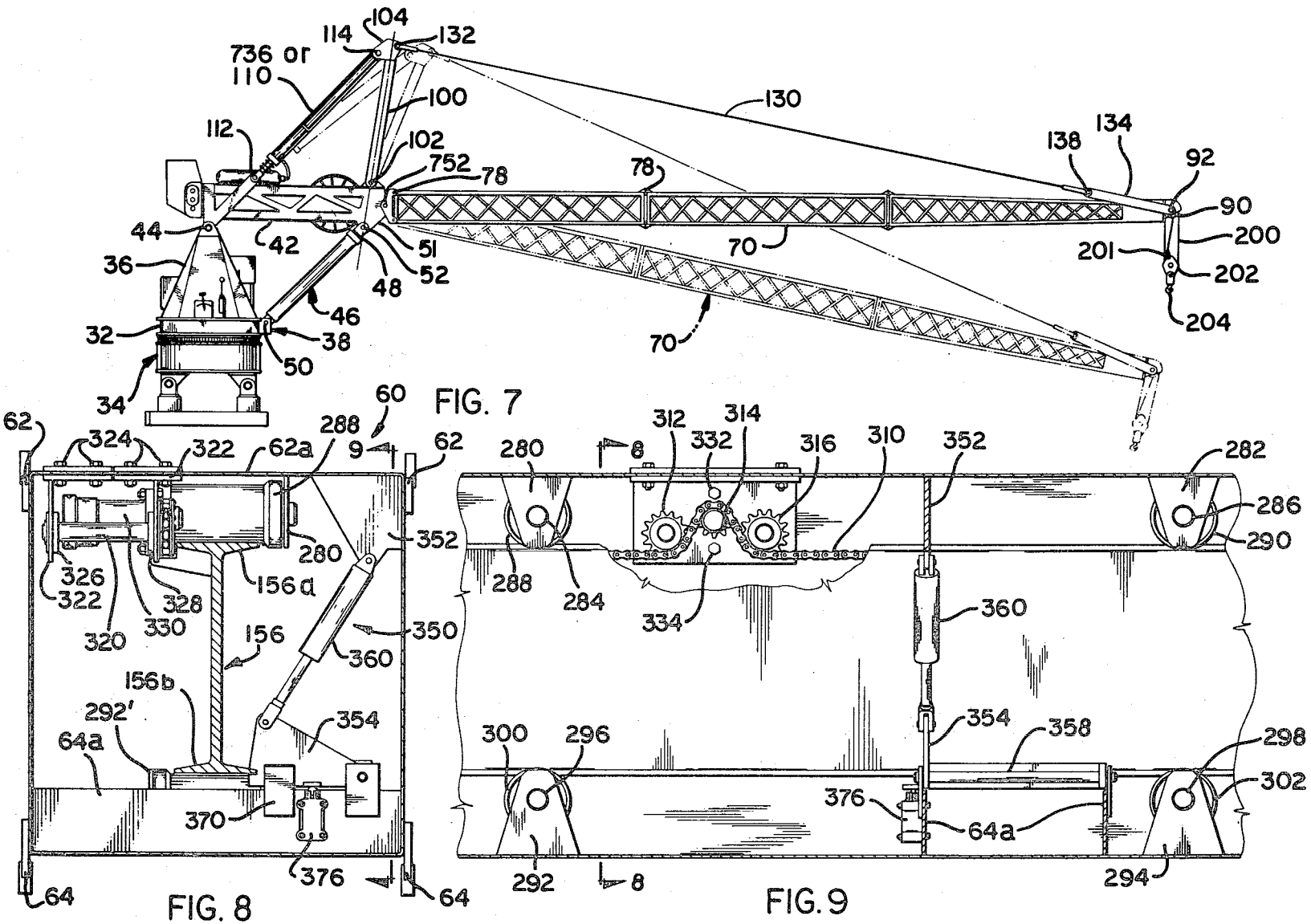
FIG. 7 is a side elevational view of a preferred embodiment of the crane of the present invention.
FIG. 8 is a sectional view taken along line 8—8 of FIG. 1.
FIG. 9 is a sectional view taken along line 9—9 of FIG. 7 showing the retraction mechanism for withdrawing the counterweight into the boom.

FIG. 7 illustrates a side view of a crane 700 constructed in accordance with one embodiment of the present invention. Crane 700 includes a base structure 32 secured to a foundation 34. A superstructure 36 is mounted on base structure 32 which rotates about a vertical axis during operation of the crane. A boom 42 is supported from superstructure 36, being pinned at its rearward end to the apex of superstructure 36 by axis shaft 44 and supported forwardly thereof by a hydraulic cylinder 46. Cylinder 46 is attached at clevis fitting 38 on the base 32 and ear 51 extending from boom 42 by axis pins 50 and 52, respectively.

A mast 100 is pivotally pinned to main boom structure 42 along the top surface thereof by axis shaft 102 and extends upwardly therefrom. The end of mast 100 remote from boom 42 is adapted with a juncture plate 104. A hydraulic cylinder 736 or optionally a mast support member 110 is connected between the main boom structure 42 by axis pin 112 and to juncture plate 104 by axis pin 114. While FIG. 7 illustrates single hydraulic cylinders 46 and 736, it will be understood that in the preferred embodiment of the invention, these elements are used in pairs with elements of each pair positioned on opposite sides of the main boom structure and operating in unison one with the other.

A boom extension 70 extends from boom 42 and is attached thereto by axis shaft 752. The end of boom extension 70 remote from main boom structure 42 is adapted with a pulley system 90 rotatably secured to boom extension 70 by rotational axis shaft 92. A strap 134 has one end supported to axis shaft 92 of boom extension 70 and the opposite end attached by way of coupling member 138 to a cable assembly 130 which supports the end of boom extension 70 remote from main boom structure 42 from juncture plate 104 and mast 100 by way of coupling 132.

As has been discussed previously with respect to other embodiments of the invention, main boom structure 42 can be constructed to receive a counter balance unit which may be telescoped outwardly to counter balance the weight supported from the working end of boom extension 70.

As will be appreciated by examination of FIG. 7, the structure is designed to provide direct load paths through mast 100 and member 110 through boom 42 into superstructure 36 and hydraulic cylinder 46. In this way, bending stresses which would normally be introduced into boom 42 are minimized with the load being substantially carried directly into superstructure 36.

Hydraulic cylinder 46 operates to pivot boom 42 about axis pin 44 by extension and retraction in the conventional manner. Additionally, hydraulic cylinder 736 serves to permit pivoting of boom extension 70 about axis pin 752 when a shock load greater than the rated capacity of the crane is imposed on the boom. The hydraulic circuit and the operation of this shock overload protection system is described hereinafter in FIG. 19.

FIGS. 8 and 9 illustrate the mechanism for retracting and extending the counterweight into and out of the boom. FIG. 8 is a sectional view taken along lines 8—8 of FIGS. 1 and 9. FIG. 9 is a sectional view taken along lines 9—9 of FIG. 8. Referring to FIG. 8, the boom structure 42 is adapted with longitudinal support members 62 and 64. Interconnected between longitudinal support members 62 and 64 are transverse support members **62*a* and 64*a*. As is shown in FIG. 9, lugs 280, 280' (not shown), 282 and 282' (not shown) extend from transverse support members 62*a*. Extending through lugs 280 and 280' and through 282 and 282' are axis pins 284 and 286, respectively. Rollers 288 and 290 are suspended on axis pins 284 and 286, respectively, and between lugs 280 and 280' and 282 and 282'**, respectively.

Similarly, lugs 292 and 292' (not shown) and 294 and 294' (not shown) extend upwardly from lower transverse support structure **64*a* to support axis pins 296 and 298 and rollers 300 and 302**, respectively.

Rollers 288, 290, 300 and 302 have a constant diameter cylindrical midsection with flanges at either end for accepting upper and lower caps **156*a* and 156*b* of counterweight I beam 156. Counterweight I beam 156 rides on rollers 300 and 302 and below rollers 288 and 290 and is guided within boom structure 60** by these rollers during the retraction and extension of the counterweight assembly.

Referring to FIGS. 8 and 9, and specifically to FIG. 9, chain 310 is connected at each end to counterweight assembly 150 and is entrained about sprocket wheels 312, 314 and 316. Referring to FIG. 8, it may be seen that sprocket wheel 312 is rotatable about shaft 320 which is supported by a support bracket 322 extending downwardly from transverse frame member **62*a* and attached thereto by suitable fastening means such as bolts 324. Shaft 320 is rotatably received within support bracket 322 by bearing assemblies 326 and 328, respectively. Although not shown, sprocket wheel 316 is similarly supported within support brackets 322. Sprocket wheel 314 is driven by a suitable motor 330 which is suitably attached to support bracket 322, such as by bolts 332 and 334**.

Thus, by energizing motor 330 to rotate sprocket wheel 314, chain 310 may be driven forward or aft. By rotating sprocket wheel 314 counterclockwise (as viewed in FIG. 9), counterweight assembly 150 is moved to its extended position out of the boom. Similarly, by rotating sprocket wheel 314 clockwise, as viewed in FIG. 9, chain 310 is made to draw counterweight assembly 150 into the boom structure.

Also illustrated in FIGS. 8 and 9 is a locking mechanism 350 for locking the counterweight assembly either in the fully extended or fully retracted position and for preventing the operation of the crane assembly whenever the counterweight assembly is intermediate of these positions. Locking assembly 350 includes a bracket 352 rigidly attached to the boom structure and a lock plate 354 rotatably hinged to transverse frame structure **64*a*. A hydraulic cylinder 360 is pinned between bracket 352 and plate 354, respectively. The lock plate 354 is so positioned as to mate with notches within the lower cap 156*b* of counterweight I beam 156 when the counterweight assembly is either in the fully extended or fully retracted position. By actuating the hydraulic cylinder 360, the lock plate 354 is made to engage the notch within the lower cap 156*b* of the counterweight I beam 156 thereby restraining the counterweight assembly from movement axially along the boom structure. A support plate 370 extends upwardly and is fixedly attached to transverse frame element 64*a*. Support plate 370 provides an additional restraint to lock plate 354** and provides more rigidity thereto when in the locked position.

When lock plate 354 is in the locked position, that is, sufficiently rotated such as to engage the notch within the counterweight I beam 156, it makes contact with electrical switch 376 closing the circuitry through the crane power source and permitting operation of the unit. Otherwise, the power source to the crane system is always open, thereby preventing operation of the unit whenever the counterweight system is not in the locked position.

Referring to FIG. 9, the shaft 358 on which lock plate 354 hinges is seen to be supported at both ends by transverse frame members **64*a***.

While only four roller supports are illustrated in FIG. 9, it will be understood that any number of upper and lower roller supports may be spaced along boom structure 60 as is necessary to accommodate the movement of counterweight assembly 150 into and out of the boom structure.

Thus, the present invention discloses a crane system wherein the counterweight is pivotally hinged from a section fixedly secured to the boom. The counterweight is automatically hinged as the boom is rotated upwardly in a vertical plane such that the longitudinal axis of the counterweight remains horizontal throughout the movement of the boom. Because the counterweight structure is maintained level throughout the angular rotation of the boom, ground clearance problems are eliminated in that the counterweight maintains substantially the same position relative to the ground and other surrounding structures as the boom rotates.

Not only are the problems with respect to ground clearance of an extended counterweight attached to the boom thus alleviated, but additionally the effectiveness of the compensating moment provided by the counterweight is maintained at a maximum by retaining the maximum moment arm through which the weight of the counterweight assembly acts. This configuration is to be contrasted to prior art units where the counterweight rotates with the boom as the boom rotates upwardly thereby effectively reducing the moment arm of the counterweight. Additionally, the present invention discloses structure for permitting the retraction of the counterweight assembly into the boom for adapting the unit for use in tightly confined areas and for preparing the unit for relocation.

Further, the manner in which the counterweight moment is carried to the base structure as well as the manner in which the moment produced by the load attached to the boom is directed into the base is significant. These loads are substantially supported through cable systems 170 and cable system 130. Further, the load bearing paths represented by cable systems 170 and 130 are not interrupted by the hinging of counterweight assembly 150 in that cable system 170 provides a continuous load path from weighted unit 158 around the uppermost part of mast 100. While the tension loads on the mast from the counterweight and the boom tend to counter balance each other, the vertical load applied through cable systems 170 and 130 into mast 100 are directed into the base structure therebelow. By so directing the loads introduced by the counterweight assembly and the load carried by the boom, the loading is more directly applied to the base structure.

Figure 10:
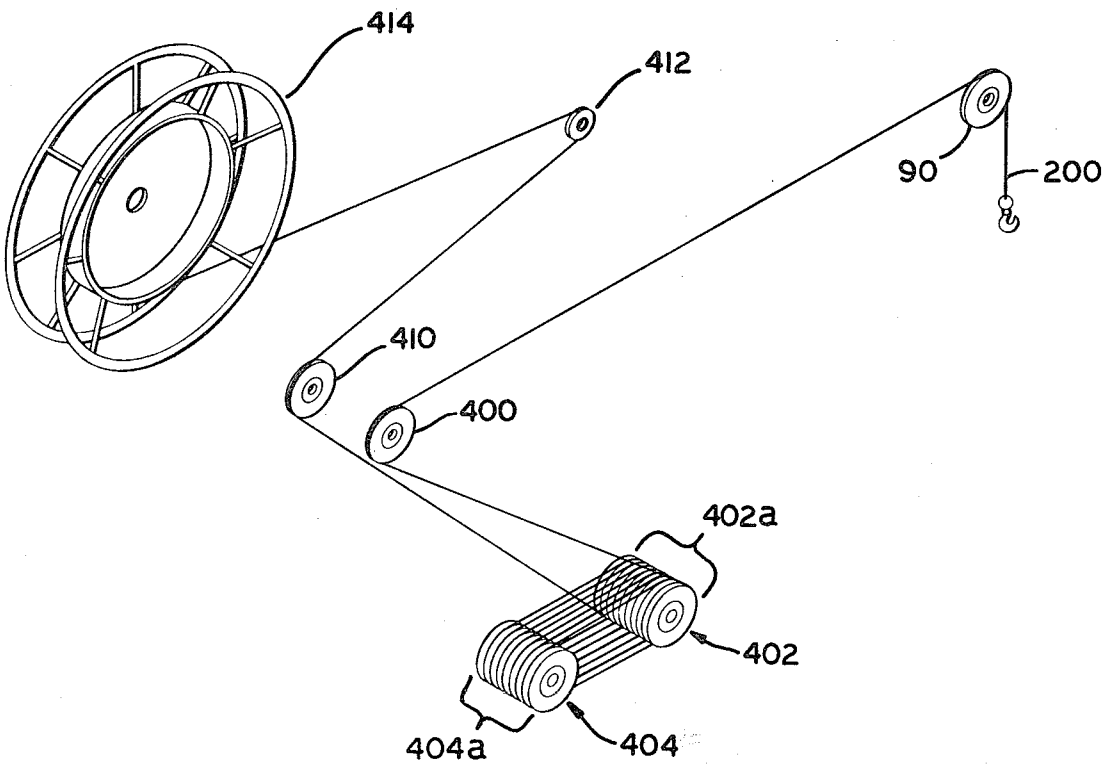
FIG. 10 is a schematic view of the hoist take-up mechanism of the present invention.

FIG. 10 illustrates in a perspective schematic view the hoisting mechanism of the present invention. In accordance with the present invention, hoist cable 200 is entrained about pulleys 90 and 400 and multiply wrapped about pulley systems 402 and 404. Pulley systems 402 and 404 each include a plurality of pulleys 402*a* and 404*a*, respectively, having a common rotational axis. The rotational axis of pulley system 402 is appropriately spaced from and parallel to that of pulley system 404. Cable 200 is multiply and alternately wrapped between pulley systems 402 and 404 such that the cable makes a single 180 degree wrap around any pulley unit 402*a* or 404*a*. Cable 200 emerges from the pulley systems 402 and 404 and passes around pulleys 410 and 412 and thereafter extends to take-up reel 414. Take-up reel 414 has an appropriate motor attached thereto (not shown) for applying a continuous nominal tensioning load, for example 50 to 60 pounds, to cable 200. Pulley assemblies 402 and 404 are suitably attached for rotation on the base structure 32 of the crane assembly. Pulleys 90, 400, 410 and 412 and take-up reel 414 are each appropriately suspended for rotation from boom structure 60. Either or both pulley systems 402 and 404 may be driven to provide the cable tension required for lifting loads. If both systems 402 and 404 are driven in the same direction of rotation the cable 200 will be wrapped around them in the manner illustrated. If the systems 402 and 404 are driven in opposite directions of rotation the cable 200 will be wrapped around the pulley systems 402 and 404 in a figure eight fashion. If only one of the pulley systems 402 or 404 is driven the cable 200 may be wrapped around the pulley systems in either 180 degree or figure eight fashion.

Figure 11:
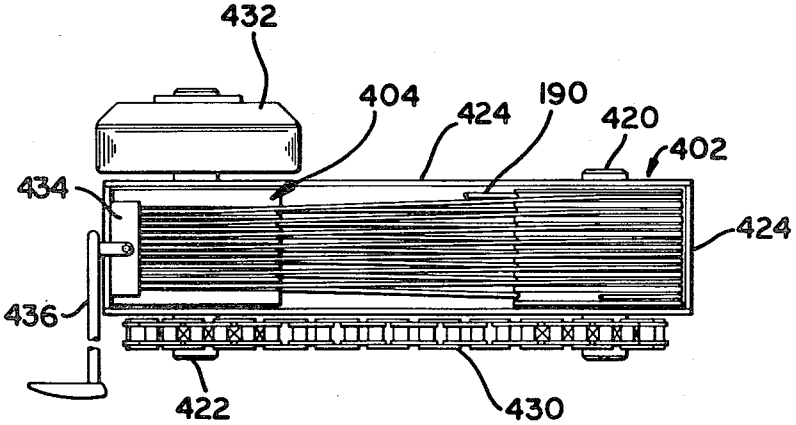
FIG. 11 is a top view as seen along line 11—11 of FIG. 10 showing the hoist mechanism of the present invention.
Figure 12:
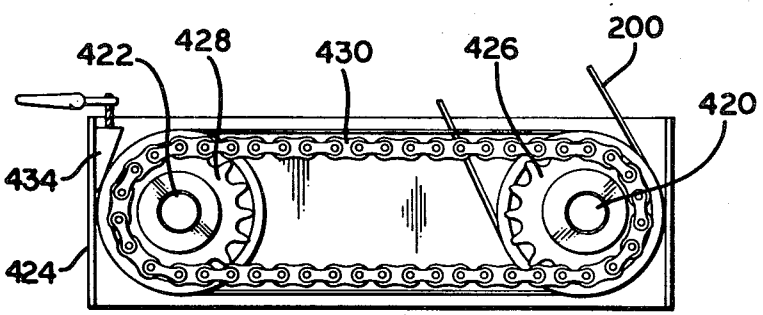
FIG. 12 is a side view of the portion of the hoist mechanism shown in FIG. 11.

FIG. 11 illustrates a top view of opposed pulley systems 402 and 404. As is best seen in FIG. 11, pulley system 402 is rotatable on shaft 420 and pulley system 404 is rotatable on shaft 422. The pulley systems are maintained with their axes of rotation in a spaced parallel relationship by support housing 424 which encircles the two pulley systems and supports the ends of shafts 420 and 422. Referring to FIGS. 11 and 12, sprocket wheel 426 is mounted for rotation with shaft 420 and sprocket wheel 428 is mounted for rotation with shaft 422. Sprocket wheels 426 and 428 are mounted on shafts 420 and 422 outside of support housing 424. Sprocket wheels 426 and 428 are coupled for rotation by endless chain 430. As may be seen in FIG. 11, an appropriate motor 432 engages shaft 422 opposite the end on which sprocket wheel 428 is mounted. Motor 432 may be powered by any suitable means. In preferred embodiments of the invention, the motor is either electrically or hydraulically powered. Thus, by rotating shaft 422, both pulley assemblies 402 and 404 may be selectively rotated either in the forward or reversed directions.

Wedge 434 is slidably positioned adjacent pulley assembly 404 and may be selectively engaged or disengaged by handle 436 between pulley assembly 404 and support housing 424. As cable 200 is wrapped such that the cable is let out by the counterclockwise rotation of pulley assembly 404, as seen in FIG. 12, wedge 434 provides a fail-safe locking function by preventing the extension of cable 200 when the wedge is engaged between pulley assembly 404 and support housing 424.

Figure 13:
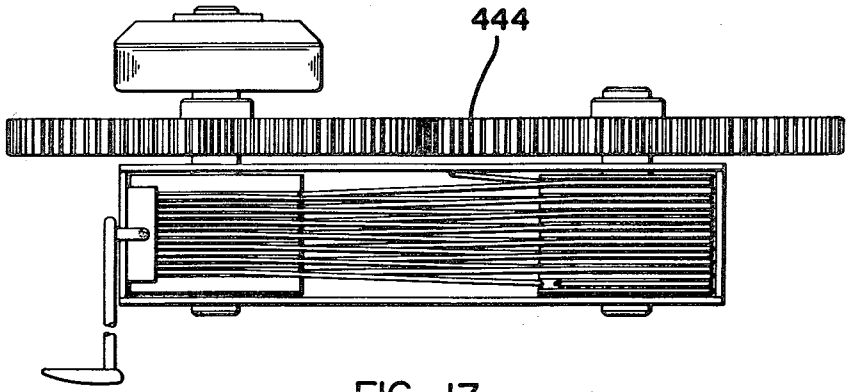
FIG. 13 is a top view of an alternative embodiment of a portion of the hoist unit used in the present invention.
Figure 14:
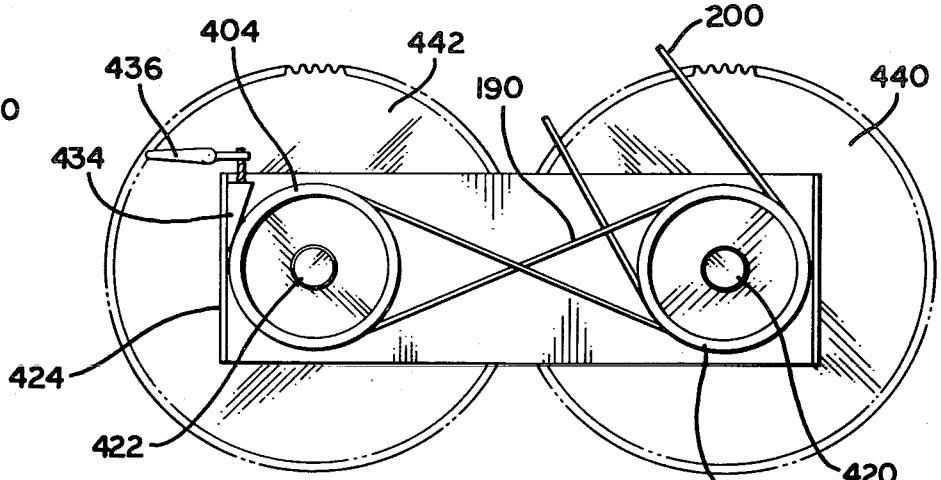
FIG. 14 is a side view of the portion of the hoist mechanism illustrated in FIG. 13.

FIGS. 13 and 14 illustrate an alternative embodiment of the hoisting mechanism illustrated in FIGS. 11 and 12. In this embodiment, cable 200 is entrained around the successive pulley elements of pulley assembly 402 in a "figure eight" wrap design. Additionally, shafts 420 and 422 of pulley assemblies 402 and 404, respectively, are adapted with gears 440 and 442 which are coupled by toothed belt 444.

Thus, by multiply wrapping cable 200 about the pulley assemblies 402 and 404, and by applying a nominal takeup load on the end of cable 200, sufficient gripping strength may be induced between the cable and the pulley assemblies to draw in and extend cable 200 under its maximum load without experiencing any slippage of the cable relative to the assemblies. By using the figure eight wrap illustrated in FIG. 14, the gripping force between cable 200 and pulley assemblies 402 and 404 is increased substantially. This arrangement may be employed where higher loading on cable 200 is experienced.

The advantages in using the arrangement illustrated in FIGS. 10 through 14 are numerous. Initially, it will be appreciated that cable 200 is not at any time wrapped over itself while under a load as in prior art hoist drums. Thus, the substantial wear experienced in prior art devices by overlaying cable on the drum is eliminated. Further, the need for attempting the prevent cross-winding of the cable onto the reel is eliminated as there is no possibility of the cable being wound on itself.

Additionally, in the prior art systems where the takeup of the load bearing cable is on a single drum, the effective diameter of the drum would naturally vary as the cable was wound onto the drum. In the present invention, the drum diameter is constant and thus the torque necessary to turn the drums will remain constant throughout the operation of the unit. Likewise, in that the torque necessary to turn the drums will remain constant it will be directly related to the load on the cable. Thus, where the spool is actuated by a hydraulic powered system, a measure of the hydraulic line pressure will be a direct indication of the working load on the cable. The cable load value is of substantial importance both in regard to the capabilities of the crane as well as in determining what the load is of the item being hoisted. Thus, the present hoisting mechanism provides a ready means for generating a reading of the load being carried by the cable as well as for eliminating problems heretofore experienced with respect to wear on the cable and power required to draw in the cable.

Figure 15:
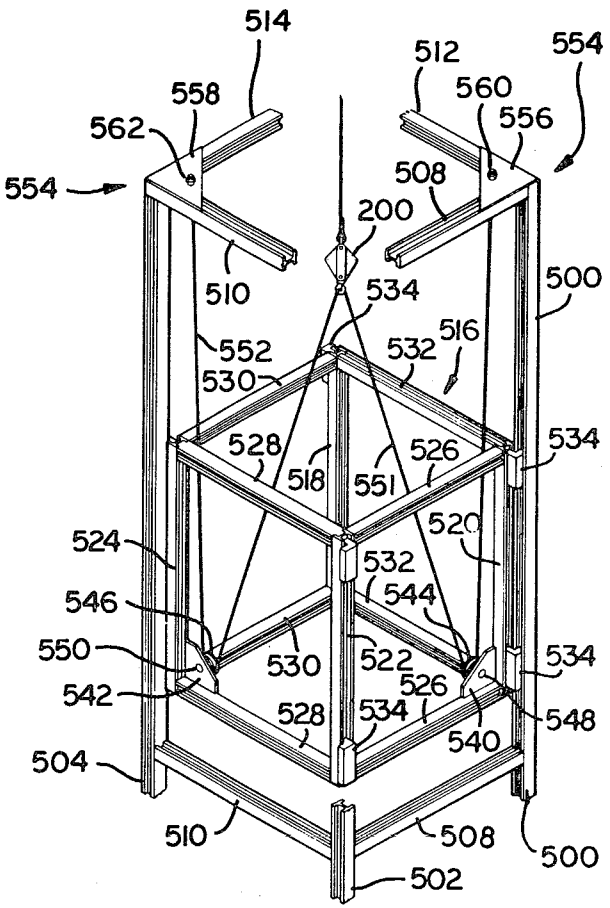
FIG. 15 illustrates the arrangement of the present invention through which the crane may be self-hoisted.

FIG. 15 illustrates a structure through which the crane system may be self-hoisted to a desired working height. The structure includes a main frame including legs 500, 502, 504 and 506 which are supported by transverse struts 508, 510, 512 and 514. Slidably engaged within the main frame is a cage structure 516 including longitudinal legs 518, 520, 522 and 524 and transverse struts 526, 528, 530 and 532. The slidable cage structure 516 is adapted at each end of its eight corners with a guide bracket 534 which mates with a groove in the legs of the main frame to permit the cage structure 516 to slide longitudinally within the main frame. Cage structure 516 is adapted with corner brackets 540 and 542 at opposed lower corners. Pulleys 544 and 546 are attached for rotation about a horizontal axis through corner brackets 540 and 542, respectively, about axis pins 548 and 550, respectively.

A cable 551 is attached at its ends to the uppermost diagonally opposed corners 552 and 554 of the main frame through corner plates 556 and 558 by suitable fasteners 560 and 562, respectively. Cable 551 is entrained about pulleys 544 and 546 and adapted for attachment to hoist block 202 extending from the crane assembly. The crane structure is mounted on slidable cage structure 516. It may be readily recognized that by applying an upward force at the midpoint of cable 551, cage structure 516, and thus the crane assembly itself, is pulled upwardly relative to the main frame.

Figure 16:
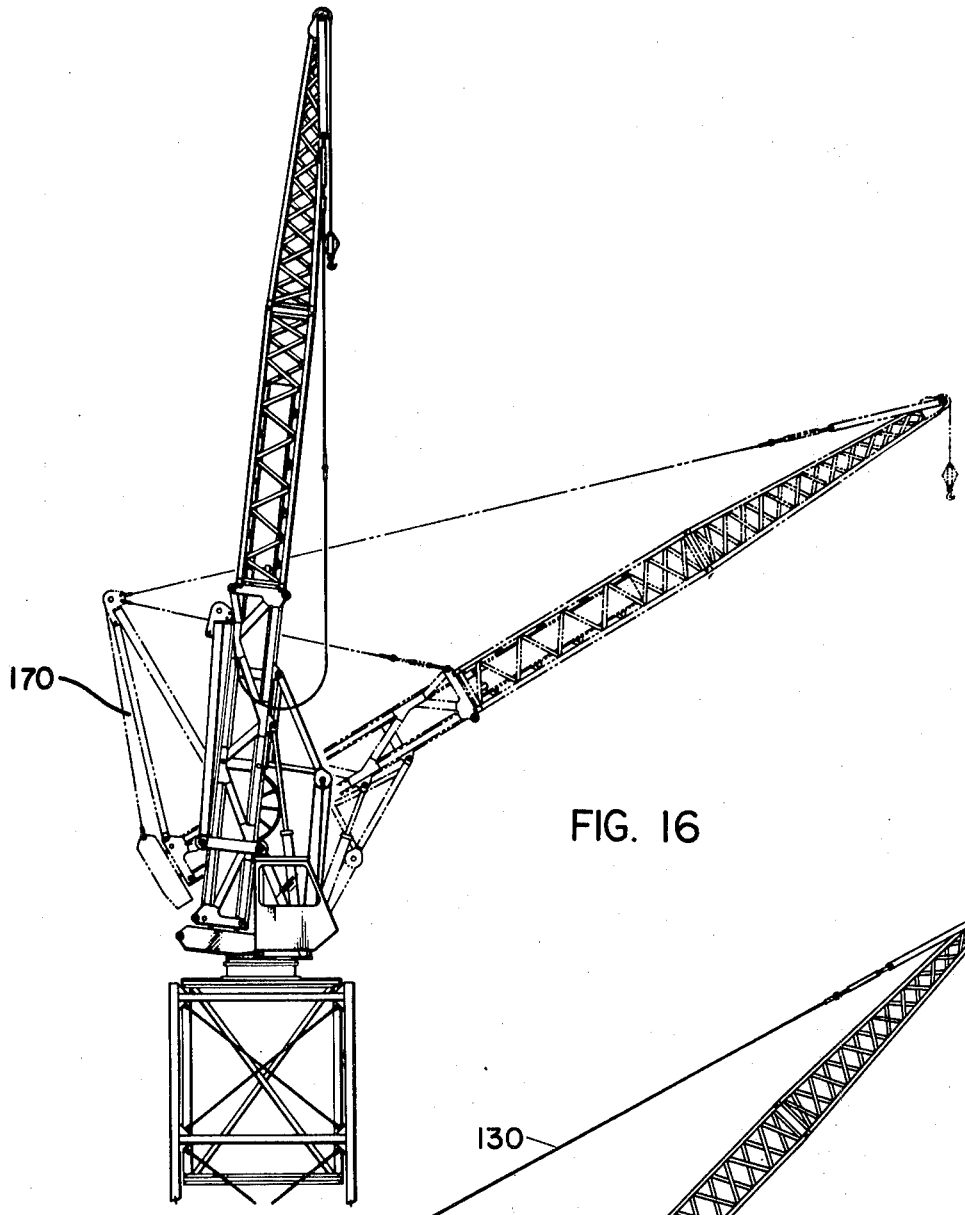
FIG. 16 illustrates the crane mounted for hoisting on the structure shown in FIG. 15.

FIG. 16 illustrates the crane moving upwardly within the main frame on cage structure 516. The crane has its boom in the most raised position, the slidable counterweight in its retracted position with the mast folded against the boom in order to clear the main frame in which the crane is elevated. It may also be seen that when the crane is raised to the top of the main frame structure, additional surrounding frame structure may be assembled. Thereafter, the cable arrangement earlier described with respect to FIG. 15 may be employed to pull the crane to higher levels as the main frame structure is extended. Thus, the crane may build its own tower and hoist itself to the top without any assistance from auxiliary equipment.

When the crane is being moved or is in operation near an adjacent interfering structure, the counterweight of the present invention may be retracted into the boom as shown. With the counterweight retracted, the boom may be rotated as when the counterweight is extended except without the benefit of the counter balancing moment produced by the counterweight when in the extended position. The geometry of the leveling cable system 170 and the pulley systems operative therewith are so arranged that the crane may be rotated to its maximum upward position without putting cable system 170 in tension. Tension in cable system 170 is unnecessary as the leveling system is non-functional when the counterbalance weight is in the retracted position. Alternatively, cable system 170 may be detached from the counterweight assembly when the counterweight assembly is in the retracted position.

Figure 17:
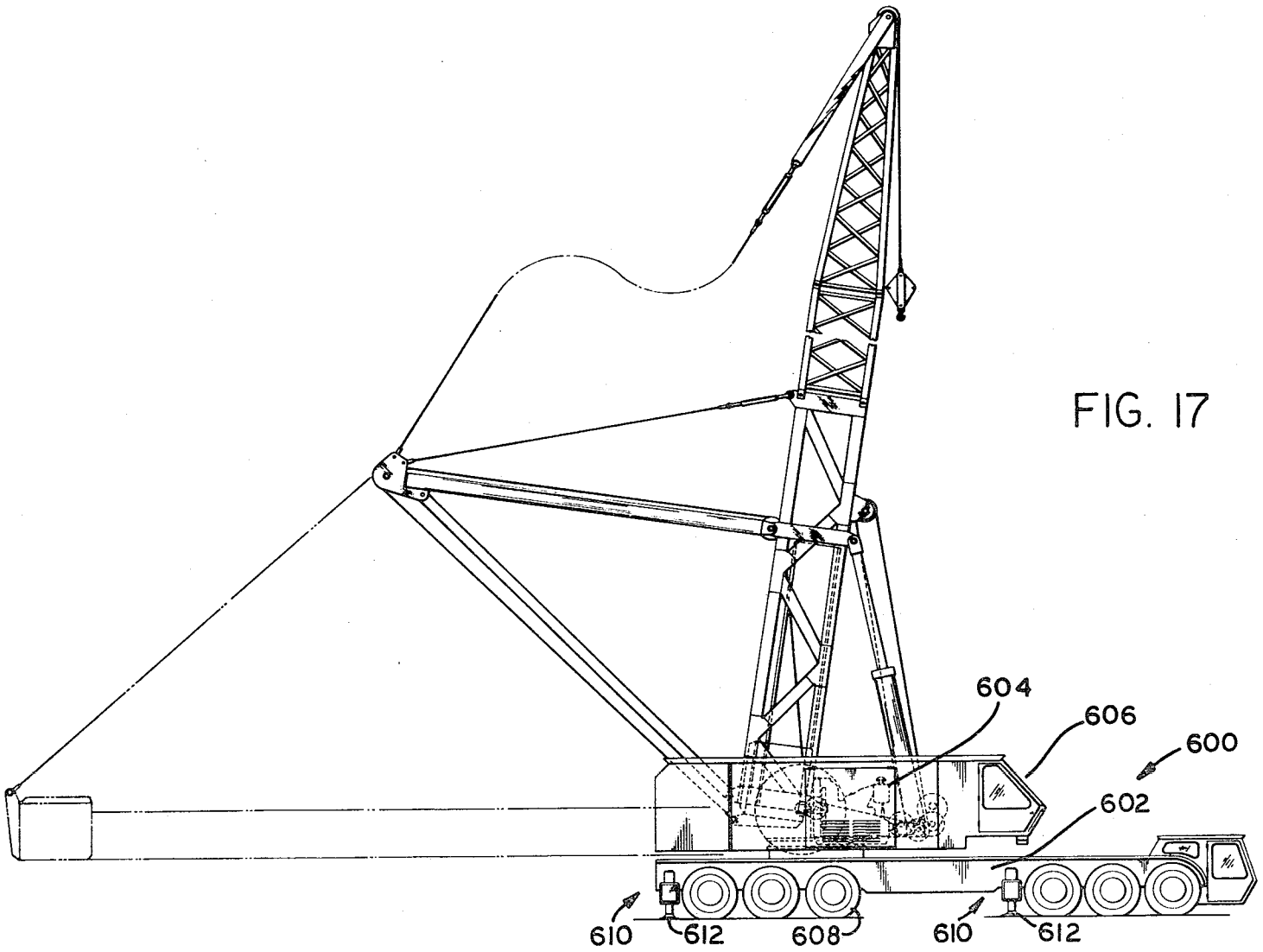
FIG. 17 illustrates the crane of the present invention mounted on a self-powered motorized vehicle.

FIG. 17 illustrates the crane of the present invention mounted on a self-powered motorized base vehicle 600. In this embodiment of the invention, the structure of the crane is similar to that described previously with respect to FIGS. 1–9. The base structure 32 is mounted onto a frame 602 of motorized vehicle 600, and the crane structure is adapted for rotation about vertical axis as well as pivoting about a horizontal axis as in the previous embodiments.

The motorized vehicle 600 is adapted with a prime mover 604 and a cab 606 supported by frame 602. The vehicle is movable on wheels 608. The vehicle may be stabilized by use of jack arms 610 positioned relative to the frame structure 602 for concentrating the load on foot pads 612 during operation of the crane.

Figure 18:
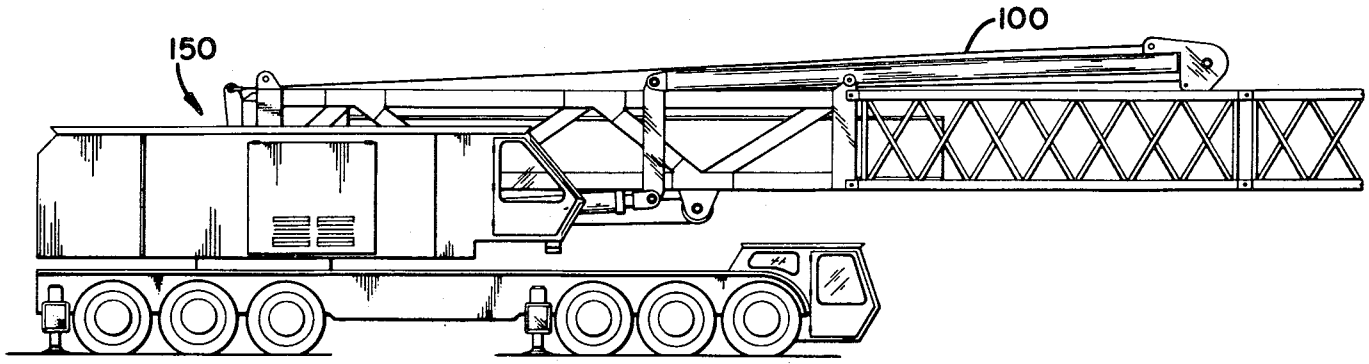
FIG. 18 illustrates the crane prepared to be moved on the motorized vehicle of FIG. 17.

FIG. 18 illustrates the embodiment disclosed in FIG. 17 wherein the crane has been positioned on vehicle 600 for movement from one location to another. As is illustrated in FIG. 18, boom structure 42 is pivoted to its most downward position, and mast 100 is likewise folded adjacent the boom structure. Additionally, counterweight assembly 150 is in its most retracted position within the boom structure.

Figure 19:
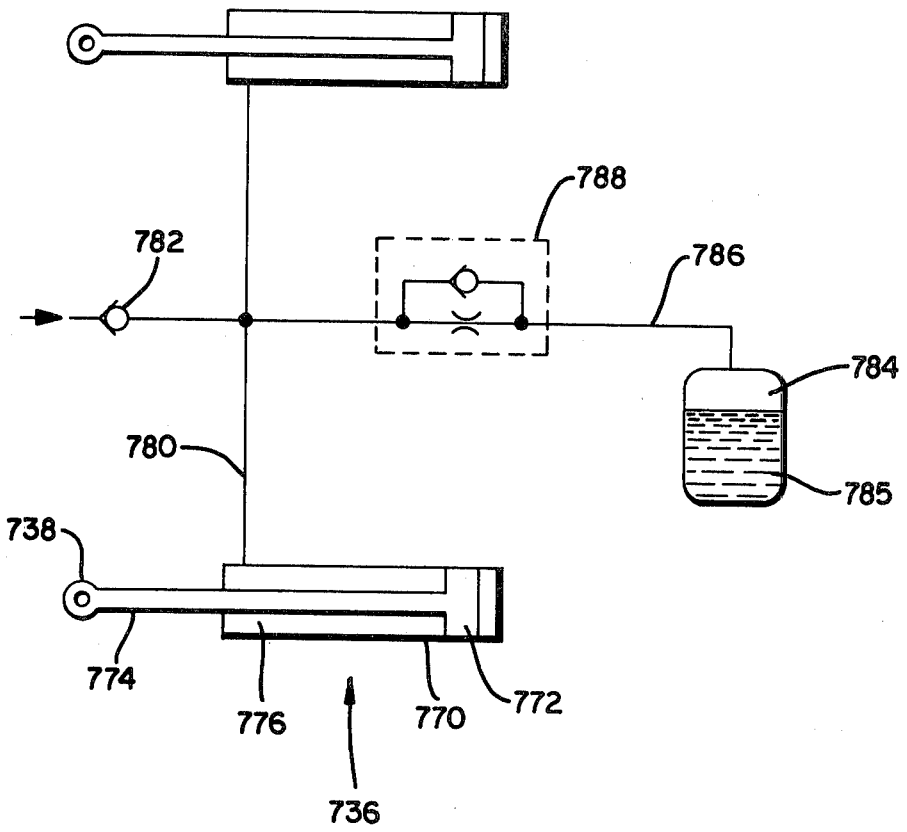
FIG. 19 illustrates the hydraulic circuit for a shock overload protection means used on the crane of the present invention.

FIG. 19 illustrates the hydraulic circuit for the shock overload protection means shown in FIG. 7. Hydraulic cylinder 736 includes a cylinder 770 and a piston 772. Piston shaft 774 extends out of the hydraulic cylinder and is attached as hereinabove indicated to boom 42 by axis pin 112. The chamber 776 formed by cylinder 770 and piston 772 within hydraulic cylinder 736 is loaded with fluid under pressure and resists the extension of hydraulic cylinder 736 and therefore the loading applied to the working end of boom extension 70. The volume of hydraulic fluid contained within cylinder 736 is sufficient to maintain boom extension 70 in line with boom 42 whenever the load applied to the working end of boom extension 70 is within the rated load capability of the crane. Cylinder 770 is also fitted with a low pressure fluid maintenance line through which fluid is automatically replenished during the operation as is necessary due to leakage. A one way check valve 782 permits the flow of fluid into cylinder 736, blocking the outflow of pressurized fluid.

An accumulator 784 communicates by way of tubing 786 to chamber 776 of cylinder 736. Accumulator 784 acts to restrain and halt the downward movement of boom section 750 when a load greater than the rated load is applied to the boom section during operation. Accumulator 784 is precharged with a gaseous medium 785, to a pressure in excess of the pressure required to support cylinder 772 in reaction to a rated load on the end of boom section 70. A directional flow control 788 in line 786 between accumulator 784 and cylinder 736 permits fluid to freely enter the accumulator whenever larger compressive loading exists within the hydraulic cylinder as a result of loading on boom 70 greater than the rated loading. As may be seen in FIGS. 7 and 19, when the rated load limit is exceeded, the force exerted on hydraulic cylinder 736 overcomes the normal pressure maintained in the accumulator 784 thereby causing piston 772 to force hydraulic fluid from chamber 776 and into accumulator 784. As fluid is moved out of hydraulic cylinder 736 and into accumulator 784, the downward movement of boom section 750 is gradually halted as the pressure within the cylinder-accumulator system becomes sufficient to counter balance the load carried by the boom extension. The directional flow control valve 788 restricts the return flow of fluid from the accumulator 784 dampening rebound action after the shock overload on boom 750 is cushioned.

A prime example of the advantage of the structure incorporated in the crane of FIGS. 7 and 19 is illustrated by the crane's operation to lift a load from a ship. In this mode of operation, the crane is normally fixed to a stationary platform and the load is lifted on hook 204 from the ship. The hook is drawn in to lift the load approaching in weight the load limit for the crane, from the ship's deck. When wave action causes the ship to simultaneously descend in the water, a resulting dynamic load is applied to the crane increasing the effective load on the crane's structure as much as two to four times to actual weight of the cargo being lifted. While there is some resiliency in the cable and other structure supporting the main boom structure and boom extension, this dynamic loading is in effect fully and immediately applied to the crane's structure and would normally exceed the structural limits of the crane. However, in the present invention, this dynamic loading is cushioned by the extension of hydraulic cylinder 736 and the resulting movement of boom extension 70 downwardly. Subsequent to the cushioning of the dynamic loading, the boom extension 70 is automatically repositioned relative to the main boom structure by the retraction of cylinder 736.

Therefore, the embodiment illustrated in FIGS. 7 and 19 provide a system which prevents impact loading which would otherwise be suffered by the structure of the crane without the movement permitted by hydraulic cylinder 736 and accumulator 784. In the present structure, dynamic loading above the rated capacity of the crane is accommodated by the movement permitted by hydraulic cylinder 736 and accumulator 784 without exceeding the structural limits of the crane.

Thus, the present invention discloses a crane operable on either a fixed or movable support structure. The crane includes a base having a boom pivotally supported at one of its ends from the base. The opposite end of the boom is adapted for receiving a load thereon. A mast is attached to the upper surface of the boom and an upper tension member system relieves the boom structure of all bending and twisting loads so that it works only under compressive loads. In another embodiment a counterweight assembly is hingedly attached to the end of the boom supported from the base. This arrangement permits the counterweight to be angularly rotated separate from the boom during pivoting of the boom in a vertical plane. In this embodiment of the invention, the crane is adapted with structure for maintaining the extended counterweight structure substantially level as the boom is pivoted on the base.

In one embodiment of the invention, the structure for maintaining the counterweight assembly level during rotation of the boom structure is a cable system extending from the counterweight to the boom structure whereby the rotation of the boom draws the cable system such that the counterweight is maintained in a level position. Alternatively, a leveling sensor is attached to the boom and controls a cable take-up mechanism which draws in and extends the cable system attached to the counterweight in order to maintain the counterweight in a level configuration during operation of the boom.

In still another embodiment of the invention, the counterweight assembly is retractable and extendable into and out of the boom structure. Structure is provided for moving the counterweight assembly axially with respect to the boom structure and for providing a locking mechanism which prevents the operation of the crane when the counterweight assembly is intermediate of its most extended or retracted position.

In accordance with still another embodiment of the invention, the crane of the present invention is adapted with a cable system extending from the weighted end of the counterweight assembly over a mast structure positioned substantially over the base of the unit and a cable system extending from the load bearing end of the boom structure to the mast structure for more effectively introducing loads and moments into the base structure from both the counterweight assembly and the loads being lifted by the crane.

Further, the present invention includes a more efficient and accurate method of hoisting in the main load bearing cable used by the crane to perform its lifting function. The system of the present invention is one which permits continuous and accurate take-up of the hoisting cable while minimizing wear and damage to the cable heretofore experienced in prior systems. Further, the present invention discloses a method through which the crane may construct its own structure and thereafter self-hoist itself to the top thereof.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A crane comprising:

a base structure;

a boom pivotally supported from the base structure for movement in a vertical plane, the boom having a first end adapted for securing a load thereto and attached to the base near the second end opposite the first end;

a counterweight hingedly attached to the second end of the boom;

means for maintaining the counterweight arm substantially level as the boom is pivoted on the base structure; said means comprising:

means attached to the counterweight for measuring the position of the longitudinal axis of the counterweight relative to horizontal; and a servo system attached to the counterweight and operative in response to the measuring means to maintain the counterweight level as the boom is pivoted.

2. The crane according to claim 1 wherein the servo system is interconnected between the base structure and the counterweight.

3. The crane according to claim 1 wherein the servo system is interconnected between the boom and the counterweight.

4. The crane according to claim 1 wherein the servo system comprises:

a winch;

a cable extending from the winch to the counterweight, the winch being operative in response to the measuring means to adjust the cable between the winch and the counterweight to maintain the counterweight substantially level throughout the movement of the boom.

5. A crane comprising:

a base structure;

a boom pivotally supported from the base structure for movement in a vertical plane, the boom having a first end adapted for securing a load thereto and attached to the base near the second end opposite the first end;

a counterweight hingedly attached to the second end of the boom;

means for maintaining the counterweight arm substantially level as the boom is pivoted on the base structure; said means comprising:

a mast extending from the boom;

a first pulley system attached to the end of the mast remote from the boom;

a winch;

a cable system extending from the counterweight, entrained about the first pulley system and attached to the winch;

means attached to the counterweight for measuring the position of the longitudinal axis of the counterweight relative to the horizontal;

means operative in response to the measuring means for actuating the winch to draw in and let out the cable system to maintain the counterweight level throughout the movement of the boom.

6. A crane comprising:

a base;

a boom pivotally supported from the base for movement in a vertical plane, the boom having a first end adapted for securing a load thereto and attached to the base near the second end opposite the first end;

a counterweight hingedly attached to the second end of the boom;

means for rotating the counterweight relative to the boom such that the counterweight remains horizontal as the boom is pivoted on the base;

means attached to the counterweight for measuring the position of the longitudinal axis of the counterweight relative to horizontal;

a servo system attached to the counterweight and operative in response to the measuring means to maintain the counterweight level as the boom is pivoted.

7. The crane according to claim 6 wherein the servo system is interconnected between the base and the counterweight.

8. The crane according to claim 6 wherein the servo system is interconnected between the boom and the counterweight.

9. The crane according to claim 6 wherein the servo system comprises:

a winch;

a cable extending from the winch to the counterweight, the winch being operative in response to the measuring means to adjust the cable between the winch and the counterweight to maintain the counterweight level throughout the movement of the boom.

10. A crane comprising:

a base;

a boom pivotally supported from the base for movement in a vertical plane, the boom having a first end adapted for securing a load thereto and attached to the base near the second end opposite the first end;

a counterweight comprising a longitudinal arm and a weight unit;

means for selectively moving the counterweight from an extended to a retracted position along a path substantially parallel to the longitudinal axis of the boom;

said longitudinal arm hingedly attached to the second end of the boom in the vertical plane of the boom;

said weight unit fixed at the end of the longitudinal arm remote from the boom;

means for maintaining the longitudinal arm substantially level as the boom is pivoted on the base;

means attached to the counterweight for measuring the position of the longitudinal axis of the counterweight relative to horizontal;

a servo system attached to the counterweight and operative in response to the measuring means to maintain the counterweight level as the boom is pivoted.

11. The crane according to claim 10 wherein the servo system is interconnected between the base and the counterweight.

12. The crane according to claim 10 wherein the servo system is interconnected between the boom and the counterweight.

13. The crane according to claim 10 wherein the servo system comprises:

a winch;

a cable extending from the winch to the counterweight, the winch being operative in response to the measuring means to adjust the cable between the winch and the counterweight to maintain the counterweight level throughout the movement of the boom.

14. A crane comprising:

a base;

a boom pivotally supported from the base for movement in a vertical plane, the boom having a first end adapted for securing a load thereto and attached to the base near the second end opposite the first end;

a counterweight attached to the second end of the boom;

means for selectively moving the counterweight from an extended to a retracted position along a path substantially parallel to the longitudinal axis of the boom;

the counterweight being hingedly attached to the second end of the boom;

a frame structure which permits the counterweight to be retracted within the boom frame structure;

a mast extending from the boom;

a first pulley system attached to the end of the mast remote from the boom;

a winch;

a cable system extending from the counterweight, entrained about the first pulley system and attached to the winch;

means attached to the counterweight for measuring the position of the longitudinal axis of the counterweight relative to the horizontal;

means operative in response to the measuring means for actuating the winch to draw in and let out the cable system to maintain the counterweight level throughout the movement of the boom.

15. A crane for use on a base structure comprising:

a boom having a first end adapted for securing a load thereto and a second end pivotally attached to the base for supporting the boom therefrom;

a mast extending upwardly from the boom intermediate the first and second ends of the boom;

a counterweight hingedly attached to the second end of the boom;

means for pivoting the boom upwardly and downwardly;

first cable means extending from the mast to a point adjacent to the first end of the boom for transmitting loads from the first end of the boom to the mast;

second cable means extending from the counterweight to the mast for counter balancing loads exerted on the mast under the loading from the boom;

means for varying the length of the second cable means in response to pivotal movement of the boom whereby the counterweight is maintained substantially level throughout the movement of the boom;

means attached to the counterweight for measuring the position of the horizontal axis of the counterweight relative to the horizontal;

a servo system operative in response to the measuring means to adjust the second cable means to maintain the counterweight substantially level as the boom is pivoted.

16. The crane accroding to claim 15 wherein the servo system comprises:

a winch;

a cable extending from the winch to the second cable means, the winch being operative in response to the measuring means to adjust the second cable means between the mast and the counterweight to maintain the counterweight substantially level throughout the movement of the boom.

* * * * *